US010507847B2

(12) United States Patent
Zhou et al.

(10) Patent No.: US 10,507,847 B2
(45) Date of Patent: Dec. 17, 2019

(54) CENTRAL TRACTION DEVICE FOR STRADDLING MONORAIL TRAIN

(71) Applicant: CRRC QINGDAO SIFANG CO., LTD., Qingdao, Shandong (CN)

(72) Inventors: Jinming Zhou, Shandong (CN); Yuejun Zhang, Shandong (CN); Huijie Zhang, Shandong (CN); Lijun Ma, Shandong (CN); Xiaojun Lv, Shandong (CN); Haiqin Zhao, Shandong (CN); Xiaojiang Zhou, Shandong (CN); Shuliang Song, Shandong (CN); Wei Zhao, Shandong (CN); Yujie Shi, Shandong (CN); Chaozhi Zhai, Shandong (CN)

(73) Assignee: CRRC QINGDAO SIFANG CO., LTD., Qingdao, Shandong (CN)

( * ) Notice: Subject to any disclaimer, the term of this patent is extended or adjusted under 35 U.S.C. 154(b) by 0 days.

(21) Appl. No.: 15/777,912

(22) PCT Filed: Dec. 13, 2016

(86) PCT No.: PCT/CN2016/109697
§ 371 (c)(1),
(2) Date: May 22, 2018

(87) PCT Pub. No.: WO2017/118265
PCT Pub. Date: Jul. 13, 2017

(65) Prior Publication Data

US 2018/0345996 A1 Dec. 6, 2018

(30) Foreign Application Priority Data

Jan. 5, 2016 (CN) ..... 2016 1 0004877

(51) Int. Cl.
*B61C 13/08* (2006.01)
*B61G 9/00* (2006.01)
*B61F 5/50* (2006.01)
*B61B 13/06* (2006.01)

(52) U.S. Cl.
CPC ..... *B61C 13/08* (2013.01); *B61B 13/06* (2013.01); *B61F 5/50* (2013.01); *B61G 9/00* (2013.01)

(58) Field of Classification Search
CPC . B61B 13/06; B61C 13/08; B61F 5/16; B61F 5/18; B61F 5/50; B61G 9/00; B61G 9/06; B61G 9/10
(Continued)

(56) References Cited

U.S. PATENT DOCUMENTS 3,741,406 A * 6/1973 Anderson ..... B61G 9/10 213/22
4,962,861 A 10/1990 Wiebe
(Continued)

FOREIGN PATENT DOCUMENTS

AR 246718 A1 9/1994
CN 2774876 Y 4/2006
(Continued)

OTHER PUBLICATIONS

International Search Report for PCT/CN2016/109697 dated Mar. 3, 2017, ISA/CN.
(Continued)

*Primary Examiner* — Zachary L Kuhfuss
(74) *Attorney, Agent, or Firm* — Yue(Robert) Xu; Apex Attorneys at Law, LLP

(57) ABSTRACT

A central traction device for a straddling monorail train includes a traction pin and a traction beam. A central sleeve is provided at the center of the traction beam, and the traction pin is mounted in the central sleeve. An inner cavity
(Continued)

of the central sleeve has a corset-shaped structure having large diameters on an upper end and a lower end and a small diameter at a middle part, forming double tapered bevels, and a resilient rubber bush is provided between an inner wall of the central sleeve and the traction pin. The device has a simple and compact overall structure and facilitates connection and separation between the train body and the bogie; by providing the lift assembly, the traction device is fixedly connected to the frame, thus the traction device can be wholly lifted; and operation process and environment of raising and lowering the vehicle are improved.

9 Claims, 9 Drawing Sheets

(58) Field of Classification Search
USPC ..... 105/141
See application file for complete search history.

(56) References Cited

U.S. PATENT DOCUMENTS

| | | | |
|---|---|---|---|
| 5,615,786 | A | 4/1997 | Hoyon et al. |
| 5,809,899 | A | 9/1998 | Kaufhold et al. |

FOREIGN PATENT DOCUMENTS

| | | | |
|---|---|---|---|
| CN | 101774388 | A | 7/2010 |
| CN | 102019940 | A | 4/2011 |
| CN | 201932179 | U | 8/2011 |
| CN | 204915705 | U | 12/2015 |
| CN | 105501245 | A | 4/2016 |
| JP | S56157163 | U | 11/1981 |
| JP | H07267086 | A | 10/1995 |
| JP | 2005081940 | A | 3/2005 |
| JP | 2005335558 | A | 12/2005 |
| JP | 2013189097 | A | 9/2013 |
| RU | 2168428 | C1 | 6/2001 |

OTHER PUBLICATIONS

The Chinese 1st Office Action dated Jun. 2, 2017 for 201610004877.7,English Translation provided by http://globaldossier.uspto.gov.

The Japanese 1st Office Action dated Oct. 29, 2018 for JP2018-528042 along with the English Summary.

Liu Shaoyong, "Car Bogie for Straddle Monorail Line in Chongqing", Modern urban track traffic., Jan. 2006, the 5-9 pages or leaf.

* cited by examiner

CENTRAL TRACTION DEVICE FOR STRADDLING MONORAIL TRAIN

This application is the national phase of International Application No. PCT/CN2016/109697, titled "CENTRAL TRACTION DEVICE FOR STRADDLING MONORAIL TRAIN", filed on Nov. 13, 2016, which claims priority to Chinese Patent Application No. 201610004877.7, titled "CENTRAL TRACTION DEVICE FOR STRADDLING MONORAIL TRAIN", filed on Jan. 5, 2016 with the State Intellectual Property Office of People's Republic of China, the enclosures of which applications are incorporated herein by reference.

FIELD

The present application relates to the technical field of rail vehicle manufacturing, and particularly to a central traction device for a straddle-type monorail train.

BACKGROUND

Straddle-type monorail traffic is a full-line overhead rail transit system which utilizes a space above ordinary roads, and thus can alleviate the ground traffic congestion problem effectively. And also, a monorail train, due to adopting a special bogie, has a strong adaptability to steep slopes and sharp bends and doesn't have strict requirements on a terrain. Furthermore, the monorail train is drawn by electric power, and there is no exhaust pollution in operation of the train, which is favorable for protection of the urban environment.

A central traction device for the bogie of the monorail train is mainly subjected to a traction force and a braking force, and is subjected to an impact of the bogie against a train body, and the central traction device is further required to satisfy the relative movement between the train body and the bogie. The central traction device mainly includes a frame, a traction pin, a traction beam, a transverse stopper, a damper and so on. In a central traction device of a conventional straddle-type monorail train, the traction beam and the traction pin are connected by a traction pin sleeve for transferring a longitudinal traction force to satisfy the relative rotation between the train body and the bogie. The traction pin sleeve in the conventional technology mostly has a cylindrical structure with equal diameters from top to bottom, and is formed by rubber and a metallic plate being vulcanized together. The traction pin sleeve bears load changes in a horizontal direction by compressive deformation of the rubber in the horizontal direction, thus having damping and buffering effect. However, the traction pin sleeve bears load changes in a vertical direction by torsional dislocation of the rubber, which weakens damping and buffering effect in the vertical direction greatly and further causes a service life of the traction pin sleeve to be reduced greatly.

SUMMARY

It is a main object of the present application to provide a central traction device for a straddle-type monorail train which has a simple structure and a better manufacturability and can bear transverse load, longitudinal load and vertical load effectively, so as to address the above issues and disadvantages.

To achieve the above object, the following technical solutions are provided according to the present application.

A central traction device for a straddle-type monorail train is provided, and the central traction device includes a traction pin and a traction beam. A central sleeve is provided at the center of the traction beam, and the traction pin is mounted in the central sleeve. An inner cavity of the central sleeve has a corset-shaped structure having large diameters on an upper end and a lower end and a small diameter at a middle part, forming double tapered bevels, and a resilient rubber bush is provided between an inner wall of the central sleeve and the traction pin.

Preferably, the resilient rubber bush includes two rubber rings which are respectively an upper rubber ring and a lower rubber ring, the upper rubber ring is mounted on a tapered bevel at an upper side of the corset-shaped inner cavity of the central sleeve, and the lower rubber ring is mounted on a tapered bevel at a lower side of the corset-shaped inner cavity of the central sleeve.

Preferably, a step-like structure converging towards the center of the traction pin is provided around an outer periphery of the traction pin, and after being mounted, the upper rubber ring is clamped between the step-like structure of the traction pin and an inner wall of the central sleeve.

Preferably, an outer periphery of a bottom portion of the traction pin has a tapered surface converging toward the center of the traction pin, and after being mounted, the lower rubber ring is clamped between the bottom portion of the traction pin and an inner wall of the central sleeve.

Preferably, the central sleeve of the traction beam has a structure which is cut-through from top to bottom, a seal plate and a lower gland are provided at a bottom portion of the central sleeve, the seal plate is fixedly connected to a bottom portion of the traction beam by a bolt, and the lower gland is fixedly mounted between the seal plate and the traction pin.

Preferably, a traction pin hole, which is cut-through from top to bottom, is provided at the center of the traction pin, and a long bolt passing through the traction pin hole is mounted in the traction pin hole, an annular positioning block is mounted at a top side of the traction pin hole and a top portion of the long bolt passes through the positioning block, a bottom portion of the long bolt has external threads, an internal threaded hole is provided at the center of the lower gland, and the bottom portion of the long bolt and the lower gland are fixedly connected by screw threads.

Preferably, a bottom portion of the central sleeve of the traction beam is recessed outward, and a seal ring is mounted between an outer circumference of the lower gland and an inner wall of the bottom portion of the central sleeve.

Preferably, a boss structure is provided on an upper surface of the lower gland, an outer circumference of a bottom portion of the traction pin has an anti-rotation planar surface which is inwardly concaved, and the boss structure of the lower gland cooperates with the anti-rotation planar surface of the traction pin to prevent rotation.

Preferably, the traction device further includes two end plates distributed in a longitudinal direction, and the two end plates are respectively mounted at outer sides of the traction pin, a top portion of each of the end plates is fixedly connected to the frame, and four traction rubber stacks are mounted between the traction beam and the two end plates.

Preferably, the traction rubber stack is formed by vulcanizing five parallel metallic plates and four layers of rubber between the adjacent metallic plates together, two positioning and mounting mandrels, which protrude out, are respectively provided on outer surfaces of two metallic plates on outermost sides, and the two positioning and mounting mandrels are respectively inserted into a rubber stack mounting hole provided in the end plate and a rubber stack mounting hole provided in the traction beam to achieve fixing.

Preferably, the traction device further includes a lift assembly comprising a lift plate, a lift baffle and a lift block; the lift plate is fixedly connected to the frame by a bolt, a through hole, through which the traction pin passes, is provided at the center of the lift plate; the lift baffle is formed by two longitudinal plates and two transverse plates, and the two longitudinal plates and the two transverse plates are fixed perpendicularly on a top of the lift plate by welding, the traction pin is located in a space enclosed by the two longitudinal plates and the two transverse plates, and each of four corners of the lift plate is welded with one lift block.

In summary, compared with the conventional technology, the central traction device for the straddle-type monorail train has the following advantages:

(1) The device has a simple and compact overall structure and facilitates achieving connection and separation between the train body and the bogie. Moreover, by cooperation between the traction beam of the corset-shaped structure, the resilient rubber bush and the traction rubber stack, the device can not only achieve transmission of traction force and braking force in operation of the vehicle better in function, but also can be adapted to changes and loading of the load in a vertical direction and a longitudinal direction better, meeting the requirements of a larger traction force and a larger load change and thus improving smoothness and comfort in operation of the vehicle greatly.

(2) By providing the lift assembly, the traction device as a whole is fixedly connected to the frame, and thus the traction device can be wholly lifted. Components of the traction device are preassembled by the lift assembly to form a modular structure and then are wholly lifted, which simplifies a manner in which the traction device and the frame are connected, facilitates overall mounting and detachment of the traction device, thus improving assembling efficiency significantly.

(3) The traction beam and the traction pin are connected by the elongated bolt, and the long bolt may be detached and mounted on the grounded, thus improving operation process and environment of raising and lowering the vehicle, thereby improving assembly efficiency dramatically.

BRIEF DESCRIPTION OF THE DRAWINGS

For more clearly illustrating embodiments of the present application or the technical solutions in the conventional technology, drawings referred to describe the embodiments or the conventional technology will be briefly described hereinafter. Apparently, the drawings in the following description are only examples of the present application, and for the person skilled in the art, other drawings may be obtained based on the drawings without any creative efforts.

Figure 1:
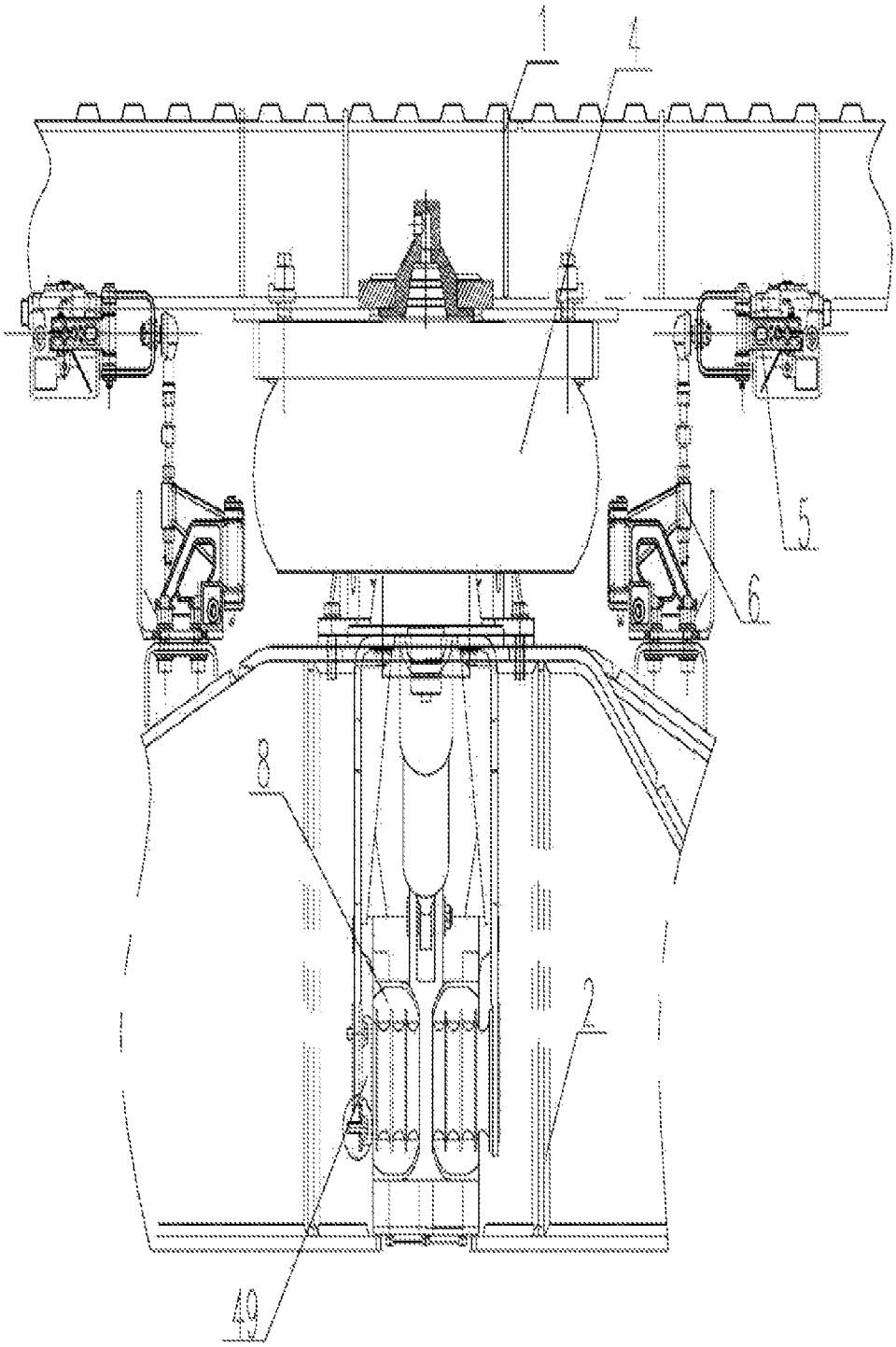
FIG. 1 is a schematic structural view of a central traction device connected to a train body according to the present application.

Reference numerals in FIGS. 1 to 9:

| | |
|---|---|
| 1. train body, | 2. bogie, |
| 3. frame, | 4. air spring, |
| 5. height adjusting valve, | 6. height adjusting device, |
| 7. central hole, | 8. traction device, |
| 9. traction pin, | 10. traction beam, |
| 11. traction rubber stack, | 12. end plate, |
| 13. lift assembly, | 14. bolt, |
| 15. flange, | 16. bolt, |
| 17. cut, | 18. rubber stack mounting hole, |
| 19. metallic plate, | 20. rubber, |
| 21. positioning and mounting mandrel, | 22. central sleeve, |
| 23. upper rubber ring, | 24. lower rubber ring, |
| 25. step-like structure, | 26. seal plate, |
| 27. lower gland, | 28. bolt, |
| 29. rubber washer, | 30. boss structure, |
| 31. anti-rotation planar surface, | 32. positioning boss, |
| 33. vertical stopper, | 34. traction pin hole, |
| 35. long bolt, | 36. external thread, |
| 37. internal threaded hole, | 38. mounting platform, |
| 39. annular positioning platform, | 40. positioning block, |
| 41. lift plate, | 42. lift baffle, |
| 42a. longitudinal plate, | 42b. transverse plate, |
| 43. lift block, | 44. bolt, |
| 45. through hole, | 46. drain hole, |
| 47. seal ring, | 48. anti-loose iron wire, |
| 49. longitudinal stopper. | |

DETAILED DESCRIPTION OF EMBODIMENTS

The present application is further described in detail hereinafter in conjunction with the drawings and embodiments.

As shown in FIGS. 1 to 4, a central traction device for a straddle-type monorail train according to the present application is configured to connect a train body 1 and a bogie 2 to achieve transmission of traction force and braking force between the train body 1 and the bogie 2.

The bogie 2 includes a frame 3, the frame 3 is a box structure formed by welding steel plates. An air spring 4 is provided on each of two sides of the frame 3. A main air chamber of the air spring 4 is connected to a height adjusting valve 5 which has an end connected to a height adjusting device 6. The height adjusting device 6 controls opening and closing of the height adjusting valve 5. In this embodiment, the air spring 4 is preferably a large convolution bellow type air spring, and since a bellow of the air spring 4 has a large diameter and the air spring has a large height, a low transverse stiffness and a low vertical stiffness, the air spring has a good dynamic performance.

A central hole 7 is provided in a central portion of the frame 3. A traction device 8 is mounted in the central hole 7. A top portion of the traction device 8 is fixedly connected to the train body 1 and a bottom portion of the traction device 8 is resiliently connected to the frame 3, thus achieving a resilient connection between the bogie 2 and the train body 1. In addition to transmitting the traction force and the braking force between the train body 1 and the bogie 2 in a longitudinal direction (a direction which extends along a travel direction of a straddle-type train), the traction device can also reduce transverse, longitudinal, and vertical impact loads between the bogie 2 and the train body 3 significantly and improve a dynamics performance of vehicle operation, thereby improving smoothness and comfort in operation of the train.

The traction device 8 includes a traction pin 9, a traction beam 10, a traction rubber stack 11, an end plate 12 and a lift assembly 13. A top portion of the traction pin 9 is fixedly connected to the train body 1. A bottom portion of the traction pin 9 is inserted into the traction beam 10, and the traction pin 9 is resiliently connected to the traction beam 10 by the traction rubber stack 11. And the traction beam 10 is connected to the frame 3 by a damper (not shown in the figure).

The traction pin 9 is formed by integral casting first and then machining, which ensures the traction pin 9 to have sufficient strength and stiffness. In this embodiment, preferably, the top portion of the traction pin 9 is fixedly connected to an underframe of the train body 1 by ten bolts 14, which not only improves a connection strength between the traction pin 9 and the train body 1, but also reduces a degree of force acting on a single bolt 14, thereby extending the service life of the bolts 14 and ensuring the safety of the vehicle operation.

Figure 2:
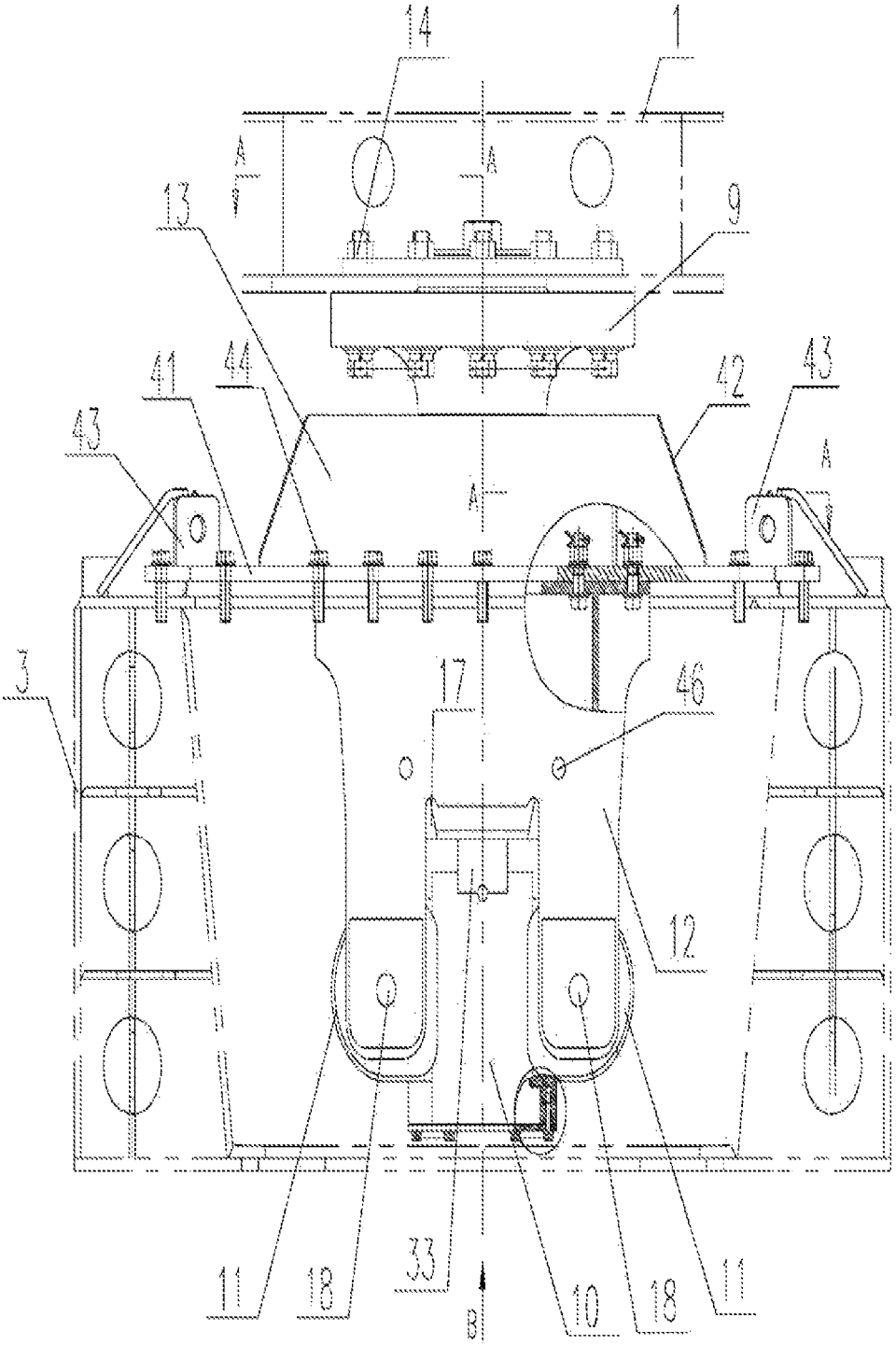
FIG. 2 is a schematic structural view of a central traction device according to the present application.
Figure 3:
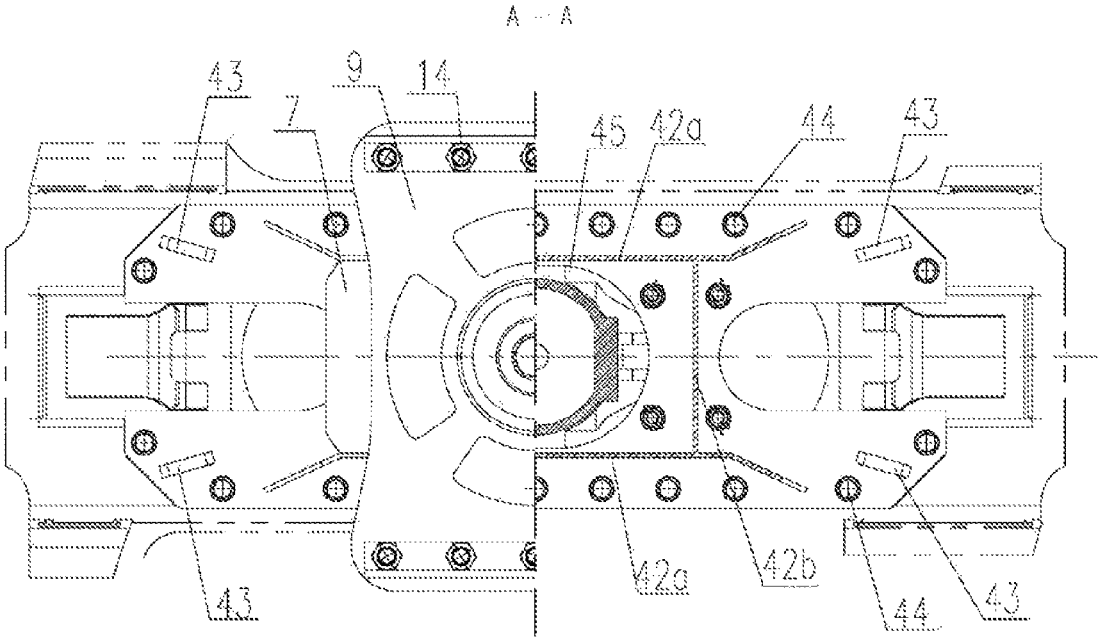
FIG. 3 is a sectional view taken along A-A of FIG. 2.
Figure 4:
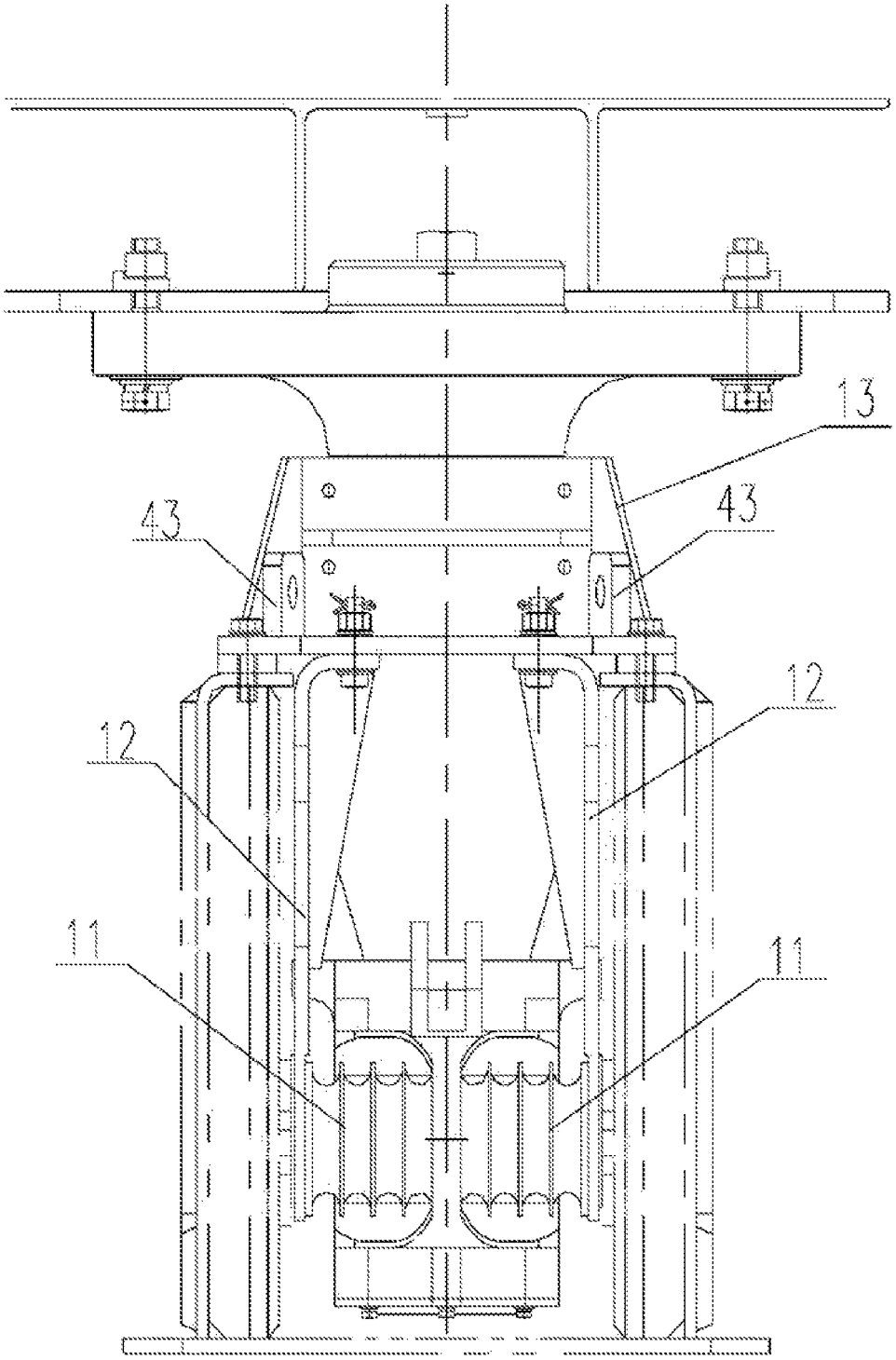
FIG. 4 is a side schematic structural view of FIG. 2.

As shown in FIGS. 2 to 4, the lift assembly 13 includes a lift plate 41, a lift baffle 42 and a lift block 43. The lift plate 41 is a piece of stainless steel plate. The lift plate 41 is fixedly connected to the frame 3 by twenty-two bolts 44, which ensures the strength of connection between the traction device 8 and the frame 3 and further reduces a degree of force acting on a single bolt 44, thereby extending a service life of the bolts 44 and ensuring the safety of the vehicle operation. A through hole 45, through which the traction pin 9 passes, is provided at a center of the lift plate 41. Other components of the traction device 8 are all fixed to the lift plate 41.

The lift baffle 42 is formed by two longitudinal plates 42*a* and two transverse plates 42*b*. The two longitudinal plates 42*a* and the two transverse plates 42*b* are perpendicularly fixed on the top of the lift plate 41 by welding. The two longitudinal plate 42*a* are also respectively connected to the two transverse plates 42*b* by welding. The traction pin 9 is located in a space enclosed by the two longitudinal plates 42*a* and the two transverse plates 42*b*. Two sides of each longitudinal plate 42*a* are further bent outward respectively to form an edgefold, which ensures an overall structural strength of the lift baffle 42. One transverse stopper (not shown in the figure) is mounted on an inner side surface of each of the two transverse plates 42*b* by a bolt. The transverse stopper adopts a rubber structure and faces the traction pin 9 at the middle. One lift block 43 is welded at each of four corners of the lift plate 41. A lift device is inserted into each of lift holes of four lift blocks 43, and thus the entire traction device 8 may be lifted.

The traction device 8 and the frame 3 are fixedly connected together by the lift assembly 13, and the whole traction device 8 can be lifted by the lift assembly 13 and thus both mounting and dismounting of the traction device 8 are very convenient, which simplifies a manner in which the traction beam 10 and the frame 3 are connected, thereby facilitating improvement of the assembly efficiency and reducing labor intensity.

As shown in FIG. 1 and FIG. 4, the number of the end plates 12 is two, and the two end plates 12 are distributed at two ends of the traction pin 9 in the longitudinal direction. The end plate 12 is made of a stainless steel plate. The end plate 12 is mounted inside the central hole 7 of the frame 3 and arranged in a vertical direction. An upper edge of each of the two end plates 12 is bent inward to form a flange 15, and the flange 15 is fixedly connected to the lift plate 41 by a bolt 16. As shown in FIG. 2, each of the end plates 12 has one cut 17 in which the traction beam 10 is mounted.

As shown in FIGS. 1 to 6, the traction rubber stack 11 is mounted between the end plate 12 and the traction beam 10. The traction rubber stack 11 is arranged to extend in the longitudinal direction and a total of four traction rubber stacks 11 are arranged between the two end plates 12. The end plate 12 at two sides of the cut is provided with two rubber stack mounting holes 18 respectively, and two traction rubber stacks 11 are mounted between of the mutually opposite end plates 12 on the two ends.

Figure 5:
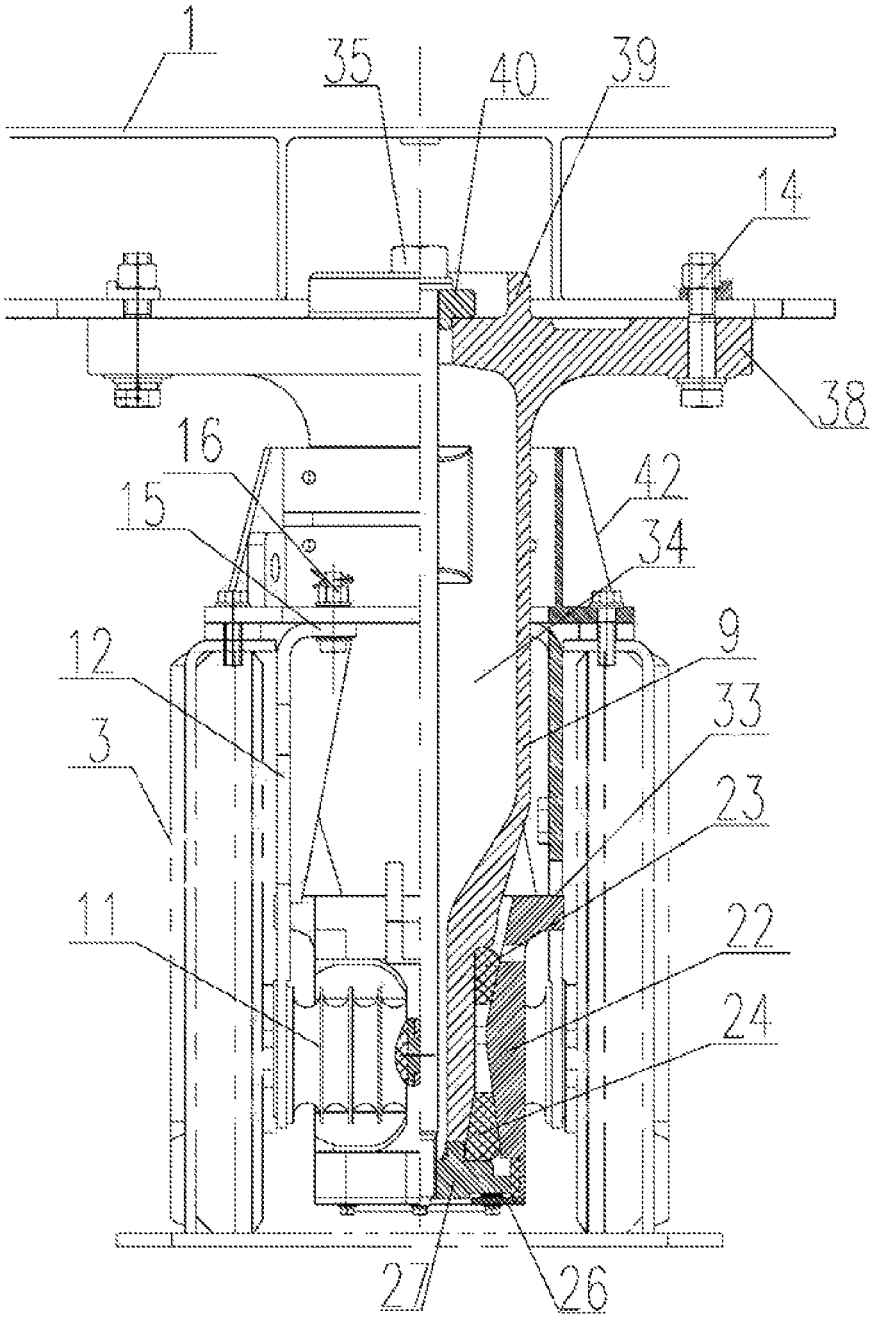
FIG. 5 is a schematic half-sectional structural view of FIG. 4.
Figure 9:
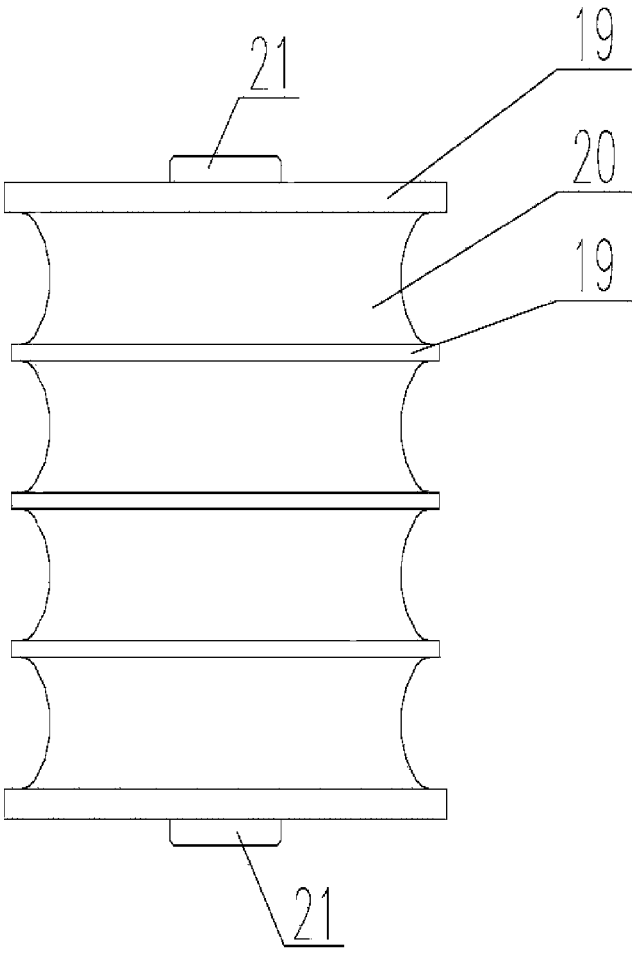
FIG. 9 is a schematic structural view of a traction rubber stack according to the present application.

As shown in FIG. 9, the traction rubber stack 11 is formed by vulcanizing five parallel metallic plates 19 and four layers of rubber 20 between the plates together. The metallic plate 19 is preferably made of a stainless steel plate, which can not only increase a vertical stiffness but also increase a horizontal stiffness. One positioning and mounting mandrel 21, which protrudes out, is provided on each of outer surfaces of two metallic plates 19 on the outermost sides. As shown in FIG. 2 and FIG. 5, one of the positioning and mounting mandrels 21 of the traction rubber stack 11 is inserted into the rubber stack mounting hole 18 of the end plate 12, and another positioning and mounting mandrel 21 is inserted into a rubber stack mounting hole (not indicated in the figure) which is provided in the traction beam 10. The positioning and mounting mandrel 21 is fixedly connected to the rubber stack mounting hole via interference fit. Such a connection manner does not require a bolt for mounting, and thus is simple and convenient for mounting, and also can achieve both positioning and bearing.

In this embodiment, the train body 1 and the frame 3 are resiliently connected by the traction rubber stacks 11 arranged longitudinally, and since the traction rubber stack 11 has a good longitudinal flexibility, a large longitudinal compression characteristic and a small vertical shear characteristic, the traction rubber stack 11 can not only improve bearing a capacity of the vehicle for longitudinal load, but also can allow the vehicle to withstand a certain vertical load, thus can have a good damping and buffering effect when being used to connect the train body 1 and the bogie 2, thereby significantly reducing impact load between the train body 1 and the bogie 2 and improving comfort in operation of the train.

As is shown in FIG. 1, a longitudinal stopper 49 is further provided on each frame 3. The longitudinal stopper 49 is mounted to the frame 3 by a bolt and protrudes out in a direction toward the intermediate traction beam 10, so as to limit a longitudinal movement distance of the traction beam 10.

Figure 6:
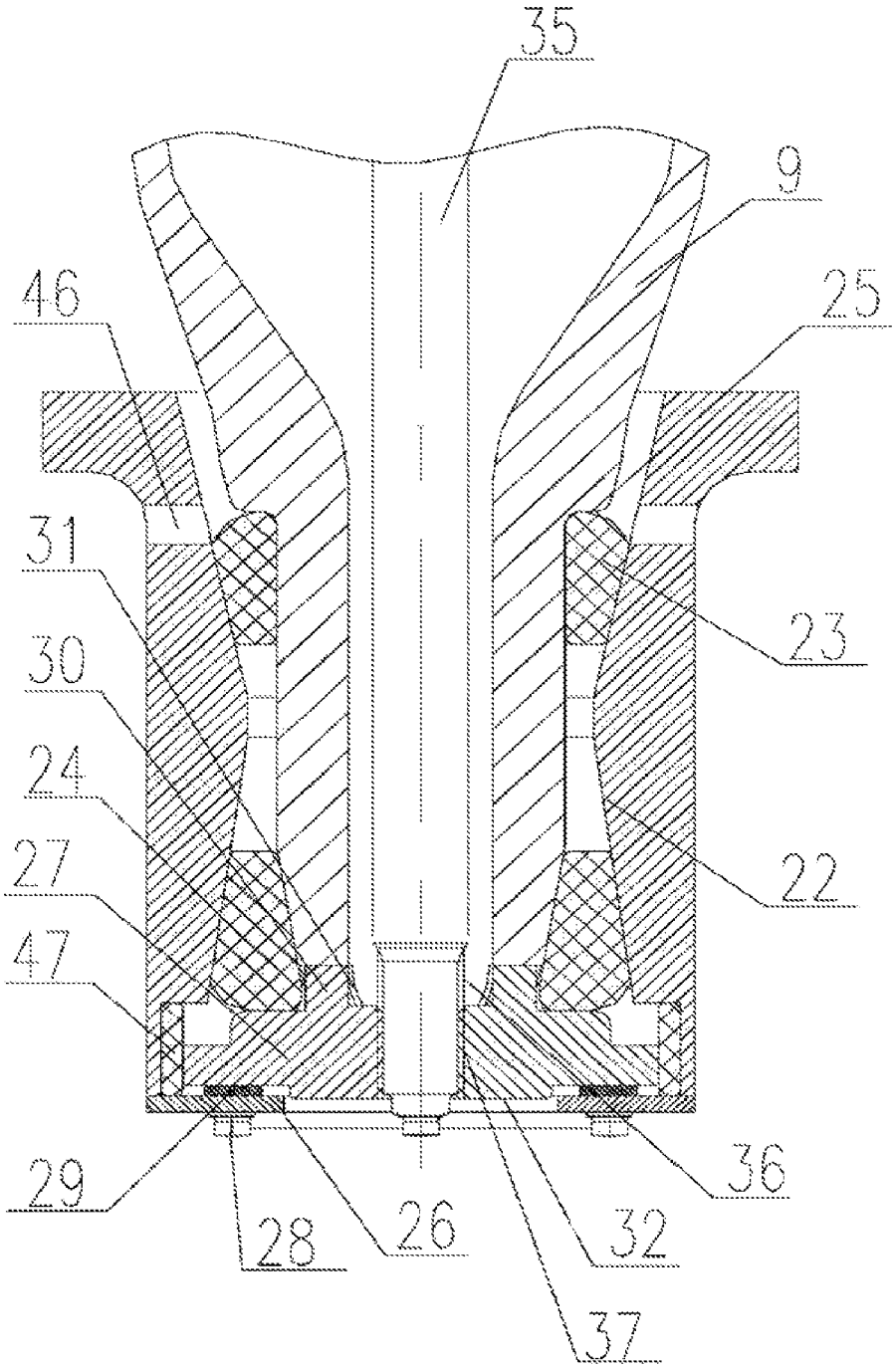
FIG. 6 is a schematic structural view of a traction pin and a traction beam after mounting according to the present application.

As shown in FIG. 5 and FIG. 6, in this embodiment, a central sleeve 22 is provided at the center of the traction beam 10. The traction pin 9 is mounted in the central sleeve 22. The traction beam 10 is also formed by integral casting first and then machining to ensure its overall bearing strength. An inner cavity of the central sleeve 22 is of a corset-shaped structure having large diameters on an upper end and a lower end and a small diameter at a middle, forming double tapered bevels. A resilient rubber bush is provided between the traction beam 10 and the traction pin 9. The resilient rubber bush may have a corset-shaped structure with the same shape as that of the central sleeve 22. In this embodiment, the resilient rubber bush is preferably embodied as a structure with two rubber rings which are respectively an upper rubber ring 23 and a lower rubber ring 24. The upper rubber ring 23 is mounted on a tapered bevel at an upper side of the corset-shaped inner cavity of the central sleeve 22 while the lower rubber ring 24 is mounted on a tapered bevel at a lower side of the corset-shaped inner cavity of the central sleeve 22. In this way, no matter an upward relative movement or a downward relative movement occurs between the traction pin 9 and the traction beam 10, a vertical load can be withstand by the upper rubber ring 23 and the lower rubber ring 24, to achieve a bidirectional buffering effect in the vertical direction and also achieve a buffering effect in the horizontal direction. Moreover, the vertical load can be withstand only by the compressive deformation of the upper rubber ring 23 and the lower rubber ring 24, which not only enables the upper rubber ring 23 and the lower rubber ring 24 to have a good damping and buffering effect, but also can extend service lives of the upper rubber ring 23 and the lower rubber ring 24 compared with the conventional technology. With the cooperation of the traction beam 10 having a corset-shaped structure, the upper rubber ring 23, the lower rubber ring 24 and the traction rubber stack 11, the traction device 8 can adapt to the variation and loading of the loads in the vertical direction and the longitudinal direction better, which greatly improves the smoothness and comfort in operation of the vehicle.

Each of cross-sections of the upper rubber ring 23 and the lower rubber ring 24 also has a substantially tapered structure. A step-like structure 25, which converges toward the center of the traction pin 9, is provided around an outer periphery of the traction pin 9. After being mounted, the upper rubber ring 23 is clamped between the step-like structure 25 of the traction pin 9 and an inner wall of the traction beam 10. An outer periphery of a bottom portion of the traction pin 9 also has a tapered surface which converges toward the center of the traction pin 9, and the lower rubber ring 24 is clamped between the bottom portion of the traction pin 9 and the inner wall of the traction beam 10.

Figure 7:
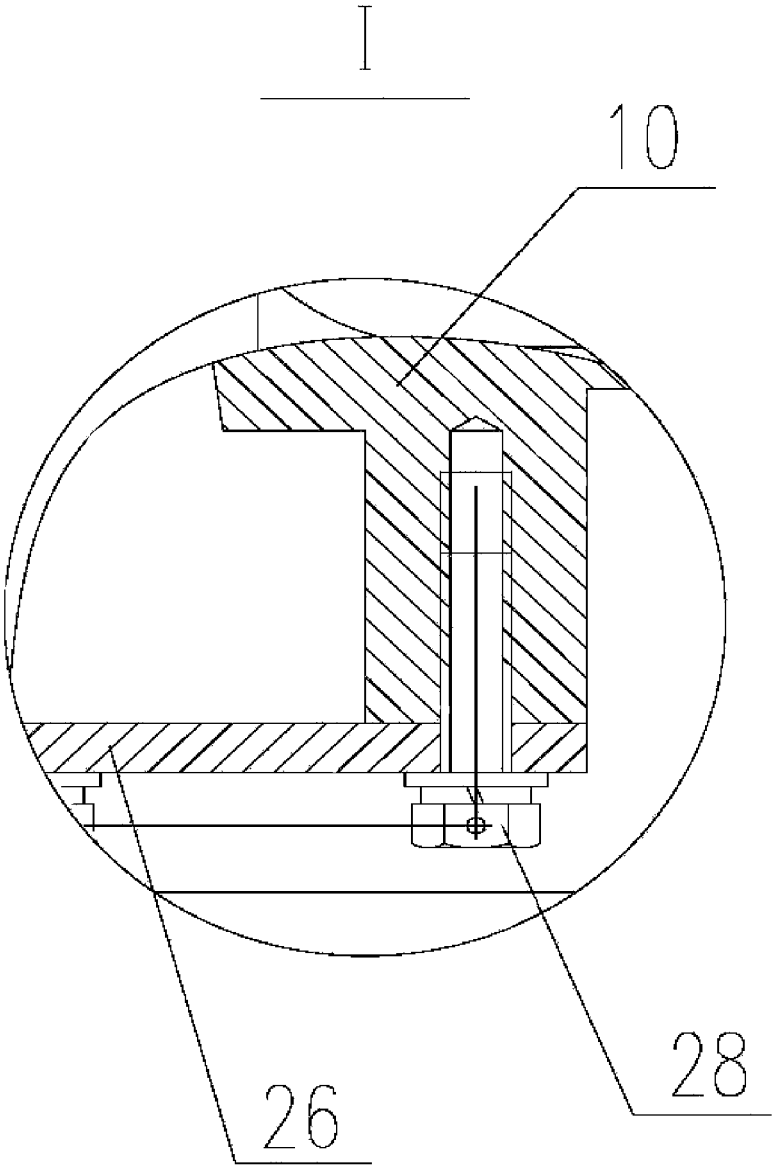
FIG. 7 is a partially enlarged view of FIG. 2.
Figure 8:
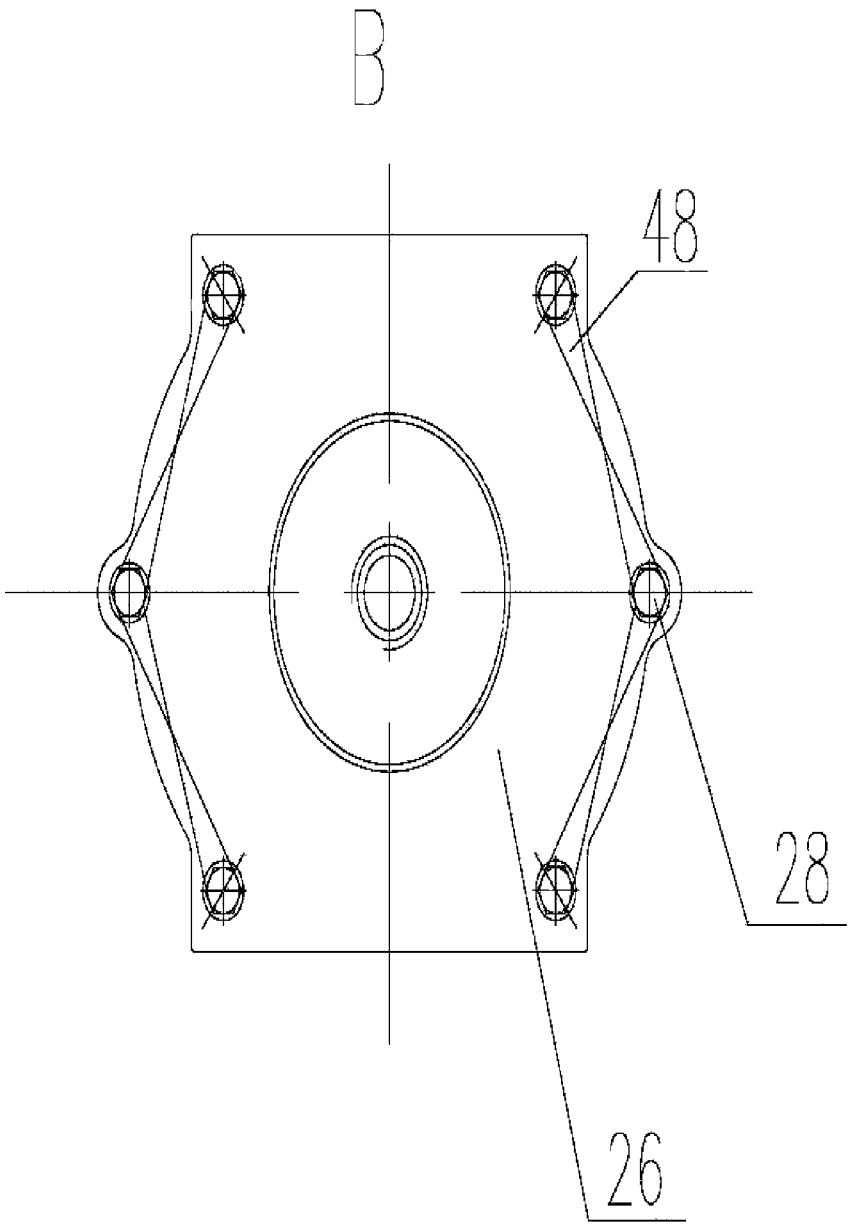
FIG. 8 is a schematic structural view of FIG. 2 in a direction of B.

A seal plate 26 and a lower gland 27 are provided the bottom of the central sleeve 22 of the traction beam 10. As shown in FIG. 7 and FIG. 8, a cross-section of the traction beam 10 has a substantially hexagonal shape, and the seal plate 26 also has a hexagonal annular shape. The seal plate 26 is fixedly connected to the bottom of the traction beam 10 by six bolts 28. The bolt 28 is further mounted with an anti-loose iron wire 48, which avoids loosening of the bolt 28 due to vibration in the running process of the vehicle thus ensuring running safety of the vehicle. The lower gland 27 is mounted between the seal plate 26 and the traction pin 9. A rubber washer 29 is provided between a lower surface of the lower gland 27 and the seal plate 26. The rubber washer 29 serves the function of a damping and buffering, and may further adjust a distance between the seal plate 26 and the traction pin 9. A bottom portion of the inner cavity of the central sleeve 22 of the traction beam 10 is recessed outward. A seal ring 47 is provided between an outer circumference of the lower gland 27 and the bottom portion of the inner cavity of the central sleeve 22. The seal ring 47 not only serves the function of sealing but also serves the function of buffering and damping. In this case, the lower gland 27 further serves the function of position-limiting and fixing the lower rubber ring 24. A boss structure 30 is provided on an upper surface of the lower gland 27. The bottom portion 9 of the traction pin 9 has an inwardly concaved anti-rotation planar surface 31. The boss structure 30 of the lower gland 27 cooperates with the anti-rotation planar surface 31 of the traction pin 9 to function to prevent rotation.

A lower surface of the lower gland 27 has a positioning boss 32 protruding downwards. After being mounted, the positioning boss 32 cooperates with a central hole of the seal plate 26 to achieve a central positioning of the traction beam 10 and the traction pin 9.

Since the traction pin 9 and the traction beam 10 are connected in a sealed manner by the upper rubber ring 23, the traction beam 10 in this embodiment is provided with a drain hole 46 configured to drain rainwater and water for washing the train, etc.

As shown in FIG. 2 and FIG. 5, the traction beam 10 has a vertical stopper 33. A distance between an upper surface of the vertical stopper 33 and a top of the cut 17 of the end plate 12 is limited by the vertical stopper. In this embodiment, the vertical stopper 33 and the traction beam 10 are formed by integral casting and machining, and a large planar structure is preferably adopted, which is more convenient for machining.

As shown in FIG. 5 and FIG. 6, a traction pin hole 34, running through from top to bottom, is provided at the center of the traction pin 9. A mounting platform 38 is formed by a top portion of the traction pin 9 extending toward the outer circumference. The mounting platform 38 is fixedly connected to the train body 1 by ten bolts 14. The top portion of the traction pin 9 further has an annular positioning platform 39 protruding upward. The annular positioning platform 39 surrounds at an outer periphery of the traction pin hole 34. The annular positioning platform 39 is inserted into a mounting hole of the bottom portion of the train body 1. An annular positioning block 40 is provided at a top side of the traction pin hole 34. A long bolt 35 passing through the traction pin hole 34 is mounted in the traction pin hole 34. A top portion of the long bolt 35 is fixed to the positioning block 40. A bottom portion of the long bolt 35 has external threads 36, and an internal threaded hole 37 is provided at the center of the lower gland 27, and the bottom portion of the long bolt 35 is fixedly connected to the lower gland 27 by screw threads. The traction pin 9 and the traction beam 10 are fixedly connected together by the long bolt 35. The long bolt 35 not only has an increased length, but also can be detached from and mounted on the ground, which improves operation process and environment of raising and lowering the vehicle, thus is convenient for detachment and mounting.

An assembly process of this traction device 8 is described hereinafter in detail.

1. First, the flange 15 of the end plate 12 is fixedly connected to the lift plate 41 by the bolt 16, and the transverse stopper is mounted to each of the transverse plates 42*b* of the lift baffle 42.

2. The four traction rubber stacks 11 are mounted between the traction beam 10 and the end plates 12.

3. The lower rubber ring 24, the lower gland 27 and the seal ring 47 are mounted in the central sleeve 22 of the traction beam 10. The seal plate 26 is fixedly connected to the bottom portion of the traction beam 10 by using six bolts 28, and before mounting of the seal plate 26, a rubber washer 29 is mounted between the lower surface of the lower gland 27 and the seal plate 26. Thus, preliminary assembly of the traction device 8 is completed.

4. The top portion of the traction pin 9 is fixedly connected to the train body 1 by ten bolts 14.

5. The upper rubber ring 23 is sleeved onto the traction pin 9 from the lower side, which allows the upper rubber ring 23 to abut against the step-like structure 25 of the traction pin 9.

6. The traction device 8 formed by the above preliminary assembly is sleeved upward onto the traction pin 9 from a lower side of the traction pin 9, that is, the traction pin 9 is inserted into the central sleeve 22 of the traction beam 10 from top to bottom, and the boss structure 30 of the lower gland 27 cooperates with the anti-rotation planar surface 31 of the traction pin 9.

7. The lift plate 44 and the frame 3 are fixedly connected together by twenty-two bolts 44.

8. The long bolt 35 is inserted downward into the traction pin hole 34 of the traction pin 9 from the ground, and the external threads of the bottom portion of the long bolt 35 are fixed to the internal threads 37 of the lower gland 27 by screwing. Thus, assembly between the traction device 8 and the train body 1 is completed.

As described above, similar technical solutions may be derived from contents of the solution given in conjunction with the drawings. However, any contents without departing from the technical solution of the present application and any simple variations, equivalents and modifications in light of the technical essential of the present application are all within the scope of the technical solution of the present application.

The invention claimed is:

1. A central traction device for a straddle-type monorail train, comprising:

a traction pin, and a traction beam, a central sleeve being provided at the center of the traction beam, and the traction pin being mounted in the central sleeve, wherein:

an inner cavity of the central sleeve has a corset-shaped structure having large diameters on an upper end and a lower end and a small diameter at a middle part, forming double tapered bevels, and a resilient rubber bush is provided between an inner wall of the central sleeve and the traction pin; and wherein the central sleeve of the traction beam has a structure which is cut-through from top to bottom, a seal plate and a lower gland are provided at a bottom portion of the central sleeve, the seal plate is fixedly connected to a bottom portion of the traction beam by a bolt, and the lower gland is fixedly mounted between the seal plate and the traction pin; and wherein a traction pin hole, which is cut-through from top to bottom, is provided at the center of the traction pin, and a long bolt passing through the traction pin hole is mounted in the traction pin hole, an annular positioning block is mounted at a top side of the traction pin hole and a top portion of the long bolt passes through the positioning block, a bottom portion of the long bolt has external threads, an internal threaded hole is provided at the center of the lower gland, and the bottom portion of the long bolt and the lower gland are fixedly connected by screw threads.

2. The central traction device for the straddle-type monorail train according to claim 1, wherein the resilient rubber bush comprises two rubber rings which are respectively an upper rubber ring and a lower rubber ring, the upper rubber ring is mounted on a tapered bevel at an upper side of the corset-shaped inner cavity of the central sleeve, and the lower rubber ring is mounted on a tapered bevel at a lower side of the corset-shaped inner cavity of the central sleeve.

3. The central traction device for the straddle-type monorail train according to claim 2, wherein a step-like structure converging towards the center of the traction pin is provided around an outer periphery of the traction pin, and after being mounted, the upper rubber ring is clamped between the step-like structure of the traction pin and an inner wall of the central sleeve.

4. The central traction device for the straddle-type monorail train according to claim 2, wherein an outer periphery of a bottom portion of the traction pin has a tapered surface converging toward the center of the traction pin, and after being mounted, the lower rubber ring is clamped between the bottom portion of the traction pin and an inner wall of the central sleeve.

5. The central traction device for the straddle-type monorail train according to claim 1, wherein a bottom portion of the central sleeve of the traction beam is recessed outward, and a seal ring is mounted between an outer circumference of the lower gland and an inner wall of the bottom portion of the central sleeve.

6. The central traction device for the straddle-type monorail train according to claim 1, wherein a boss structure is provided on an upper surface of the lower gland, an outer circumference of a bottom portion of the traction pin has an anti-rotation planar surface which is inwardly concaved, and the boss structure of the lower gland cooperates with the anti-rotation planar surface of the traction pin to prevent rotation.

7. The central traction device for the straddle-type monorail train according to claim 1, wherein the traction device further comprises two end plates distributed in a longitudinal direction, and the two end plates are respectively mounted at outer sides of the traction pin, a top portion of each of the end plates is fixedly connected to the frame, and four traction rubber stacks are mounted between the traction beam and the two end plates.

8. The central traction device for the straddle-type monorail train according to claim 7, wherein the traction rubber stack is formed by vulcanizing five parallel metallic plates and four layers of rubber between the adjacent metallic plates together, two positioning and mounting mandrels, which protrude out, are respectively provided on outer surfaces of two metallic plates on outermost sides, and the two positioning and mounting mandrels are respectively inserted into a rubber stack mounting hole provided in the end plate and a rubber stack mounting hole provided in the traction beam to achieve fixing.

9. The central traction device for the straddle-type monorail train according to claim 1, wherein the traction device further comprises a lift assembly comprising a lift plate, a lift baffle and a lift block;

the lift plate is fixedly connected to the frame by a bolt, and a through hole, through which the traction pin passes, is provided at the center of the lift plate; and the lift baffle is formed by two longitudinal plates and two transverse plates, and the two longitudinal plates and the two transverse plates are fixed perpendicularly on a top of the lift plate by welding, the traction pin is located in a space enclosed by the two longitudinal plates and the two transverse plates, and each of four corners of the lift plate is welded with one lift block.

* * * * *